US007803239B2

(12) United States Patent
Scheirer et al.

(10) Patent No.: US 7,803,239 B2
(45) Date of Patent: Sep. 28, 2010

(54) SELF-ADHERED ROOFING COMPONENTS, ROOFING SYSTEM, AND METHOD

(75) Inventors: David A. Scheirer, Littleton, CO (US); Lawrence G. Glass, Highlands Ranch, CO (US); Raymond C. Swann, Kansas City, KS (US); Thomas Justin Stock, Westminster, CO (US); Richard D. Ramirez, Denver, CO (US)

(73) Assignee: Johns Manville, Denver, CO (US)

( * ) Notice: Subject to any disclaimer, the term of this patent is extended or adjusted under 35 U.S.C. 154(b) by 199 days.

(21) Appl. No.: 12/284,368

(22) Filed: Sep. 22, 2008

(65) Prior Publication Data

US 2009/0032165 A1 Feb. 5, 2009

Related U.S. Application Data

(60) Division of application No. 10/951,416, filed on Sep. 28, 2004, now Pat. No. 7,441,381, which is a continuation-in-part of application No. 10/736,118, filed on Dec. 15, 2003, now abandoned.

(51) Int. Cl.
*E04B 7/00* (2006.01)
*E04F 13/07* (2006.01)

(52) U.S. Cl. ..... 156/71; 156/247; 156/249

(58) Field of Classification Search ..... 156/71, 156/247, 249; 52/408, 409, 411, 412, 58, 52/749.12, 745.21, 94, 96, 519, 543, 552; 428/41.7, 41.8, 41.1, 40.3, 40.2
See application file for complete search history.

(56) References Cited

U.S. PATENT DOCUMENTS 2,044,788 A * 6/1936 Ochs et al. ..... 52/419
3,937,640 A * 2/1976 Tajima et al. ..... 156/71
4,039,706 A * 8/1977 Tajima et al. ..... 428/40.3
4,055,453 A * 10/1977 Tajima et al. ..... 156/279
4,077,171 A * 3/1978 Simpson et al. ..... 52/96
4,091,135 A * 5/1978 Tajima et al. ..... 428/40.3
4,112,632 A * 9/1978 Simpson ..... 52/11
4,248,926 A * 2/1981 Tajima et al. ..... 442/90
4,386,981 A * 6/1983 Clapperton ..... 156/71
4,396,665 A * 8/1983 Rowe ..... 428/148
4,421,807 A * 12/1983 Clausing et al. ..... 428/40.3
4,622,252 A * 11/1986 Strobeck ..... 428/88

(Continued)

FOREIGN PATENT DOCUMENTS

WO WO 0159230 A1 * 8/2001

*Primary Examiner*—Philip C Tucker
*Assistant Examiner*—Sing P Chan
(74) *Attorney, Agent, or Firm*—Robert D. Touslee

(57) ABSTRACT

Self-adhering flashing cap strip and end lap connector cap sheet assemblies include a reinforcing layer encapsulated within self-adhering bitumen. The bottom major surfaces of the flashing cap strips and the connector end lap cap sheets are formed by the self-adhering bitumen and the top major surfaces of the flashing cap strips and the connector end lap cap sheets have lateral edge portions formed by the self-adhering bitumen and a coated central portion that extends between the lateral edge portions. The flashing cap strips are used to interconnect cap sheets at roof surface intersections in the formation of waterproof roofing layers and the connector end lap sheets are used to connect lengths of cap sheets at the job site.

2 Claims, 7 Drawing Sheets

U.S. PATENT DOCUMENTS 4,735,838 A * 4/1988 Roberts et al. ..... 428/40.3
5,142,837 A * 9/1992 Simpson et al. ..... 52/409
5,496,615 A * 3/1996 Bartlett et al. ..... 428/144
5,605,020 A * 2/1997 Chambers ..... 52/58
5,970,667 A * 10/1999 Thaler ..... 52/219
6,505,455 B1 * 1/2003 Georgeau ..... 52/746.11
6,924,015 B2 * 8/2005 Zanchetta et al. ..... 428/40.1
7,441,381 B2 * 10/2008 Scheirer et al. ..... 52/409
2006/0141191 A1 * 6/2006 Seth et al. ..... 428/40.1

* cited by examiner

FIG. 11
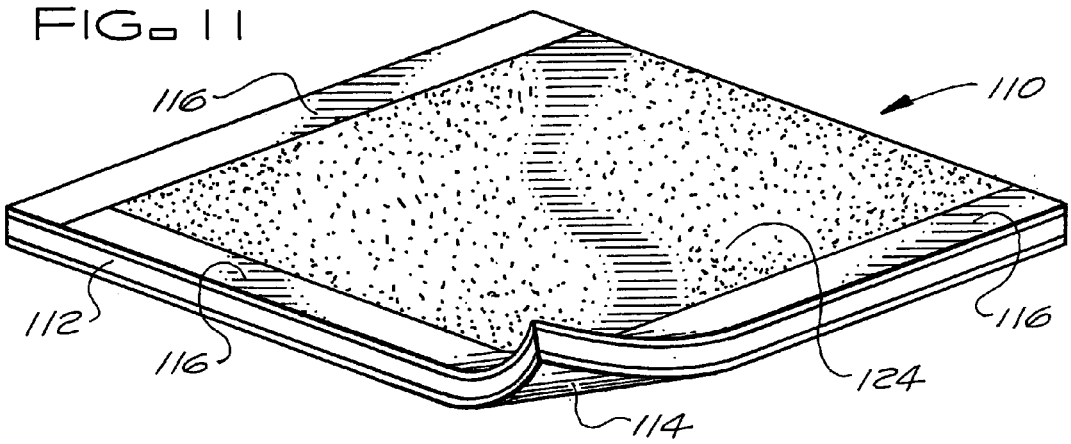
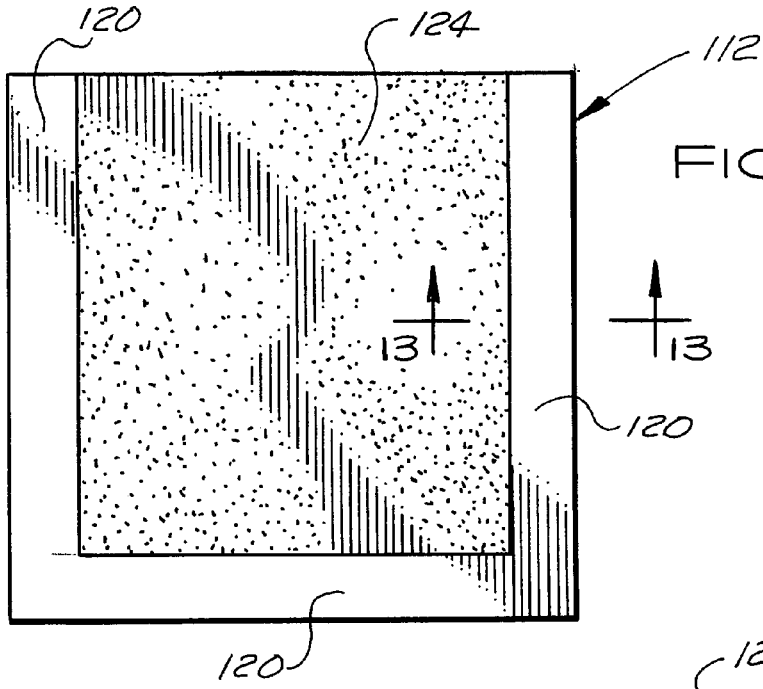
FIG. 12
FIG. 13
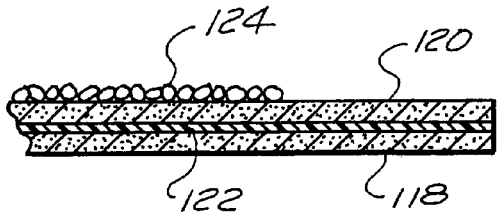
FIG. 14
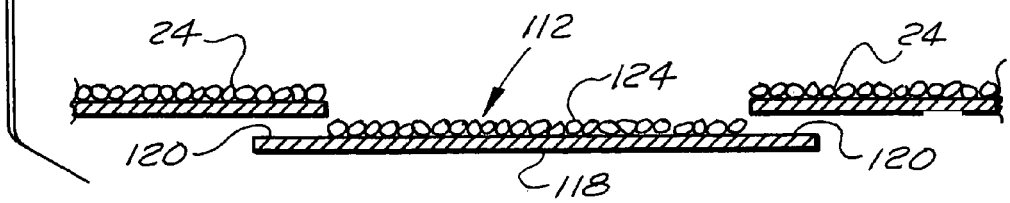

FIG. 15
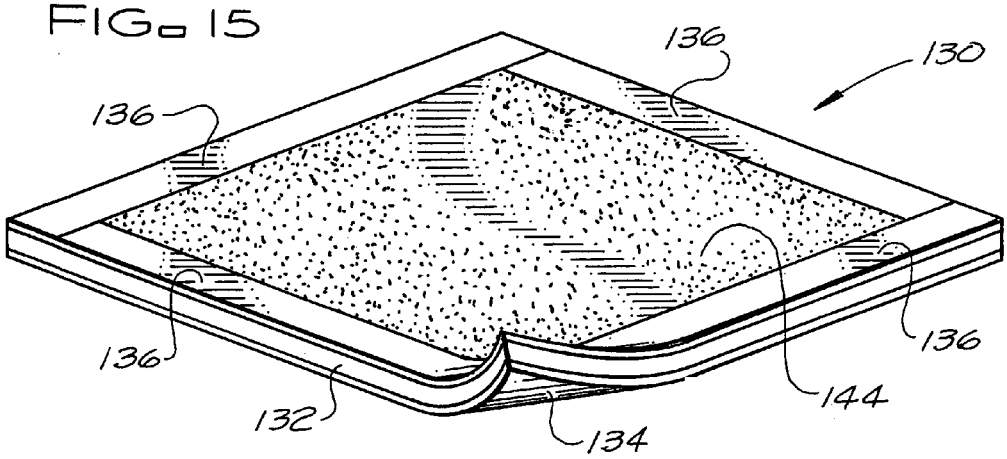
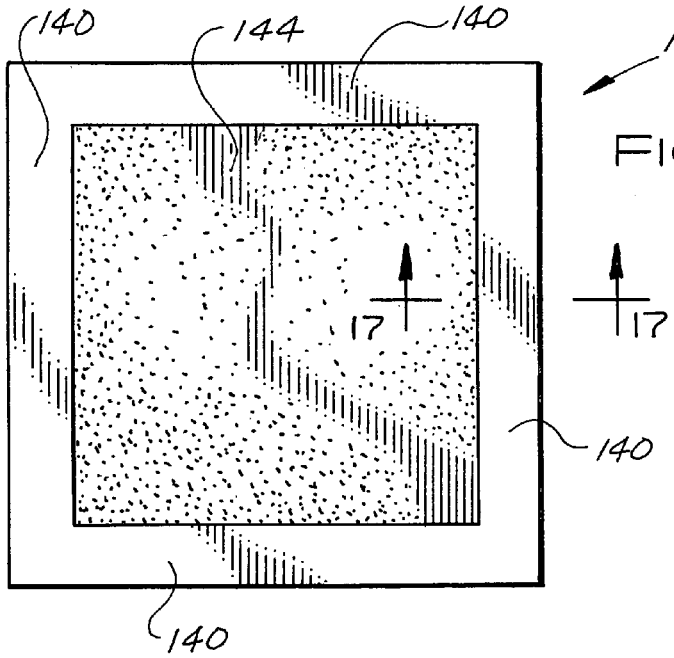
FIG. 16
FIG. 17
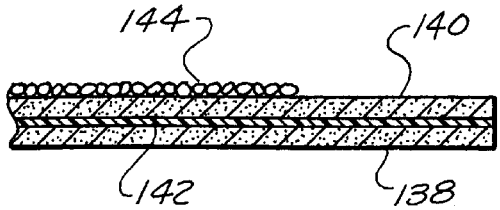

SELF-ADHERED ROOFING COMPONENTS, ROOFING SYSTEM, AND METHOD

BACKGROUND OF THE INVENTION

This application is a division of patent application Ser. No. 10/951,416, filed Sep. 28, 2004, now U.S. Pat. No. 7,441,381 which is a continuation-in-part of patent application Ser. No. 10/736,118, filed Dec. 15, 2003 abandoned.

The subject invention relates to waterproof self-adhering flashing cap strips, end lap connector cap sheets, and corner end lap connector cap sheets; roofing systems utilizing such self-adhering flashing cap strips, end lap connector cap sheets, and corner end lap connector cap sheets; the method of installing roofing systems utilizing such self-adhering flashing cap strips, end lap connector cap sheets, and corner end lap connector cap sheets; and flashing cap strip, end lap connector cap sheet, and corner end lap connector cap sheet assemblies used in the method of the subject invention. Typically, the flashing cap strips are used to interconnect cap sheets at roof surface intersections in the formation of waterproof cap sheet roofing layers; the end lap connector cap sheets are used to connect lengths of cap sheets at the job site; and the corner end lap connector cap sheets are used to connect cap sheets and form flashings at roof corners.

The central field portions of roofing systems utilizing waterproof self-adhering cap sheets to form the cap sheet layers of the system do not rely on the application of heat by the installer to the overlapping lateral edge portions of successive cap sheets or the application by the installer of secondary adhesives to the overlapping lateral edge portions of the successive cap sheets to form watertight seams between the overlapping lateral edge portions of the successive cap sheets. However, in accordance with current installation procedures at roof surface intersections having a marked change in slope or direction (roof surface intersections such as, but not limited to: roof valleys formed by intersecting roof surface planes of a roof deck, perimeter wall surfaces projecting upward from flat roof decks; roof expansion joints with surfaces projecting upward from the general plane of a roof deck, etc.), installers use a flashing procedure that includes the application of heat and/or a secondary adhesive (preferably both) to the overlapped roofing granule coated lateral edge portions of the self-adhering cap sheets of the cap sheet layer to form watertight flashing seams between the successive cap sheets of the layer. This flashing procedure includes a step referred to as the heat sinking of the roofing granules on the overlapped lateral edge portions. In this step, installers apply heat with a hot air gun or similar heating tool to the roofing granule coated top lateral edge portions of the cap sheets that are to be overlapped by the lateral edge portions of adjacent cap sheets. The installers apply heat to the roofing granule coated top surfaces of these lateral edge portions and heat these edge portions until the self-adhering bitumen in these lateral edge portions is softened and semi-fluid. With the bitumen softened and semifluid, the roofing granules coating the top surfaces of these top lateral edge portions are pressed down into the bitumen to the extent practical to form better bonding surfaces for the flashing seams. After heat sinking the roofing granules on the lateral edge portions of the cap sheets to be overlapped, a secondary adhesive is typically applied between the overlapping lateral edge portions forming the flashing seams between the adjacent cap sheets of the flashings. While the above flashing procedure, if properly performed, makes a watertight seam between the overlapping lateral edge portions of the cap sheets forming a flashing of a cap sheet layer, the flashing procedure is time consuming and the skill of and the care employed by the installer in forming the flashing seam between such lateral edge portions of the cap sheets can greatly affect the integrity and water transmission retarding or barrier characteristics of the flashing seam. While current flashing installation procedures for cap sheet layers at roof surface intersections has been discussed in connection with waterproof self-adhering cap sheets, waterproof cap sheets that are not self-adhering would require the use of the same or similar procedures.

Currently, as successive lengths of cap sheets must be joined at the job site, the end portions (head laps) of the successive lengths of cap sheets are connected together at the job site by heat sinking the granules on the cap sheet end portion to be overlapped and applying a secondary adhesive between the overlapped end portions of the cap sheets to bond the successive lengths of cap sheets together in a manner similar to the formation of flashing seams discussed above.

Thus, it can be seen that there is a need for cap sheet flashing materials, cap sheet connectors, and installation procedures that enable flashings for cap sheet layers and the connection of successive lengths of cap sheets for cap sheet layers to be easily, quickly, and effectively formed without the need for the application of heat by the installer, the heat sinking of granules, or the use of a secondary adhesive.

SUMMARY OF THE INVENTION

The waterproof self-adhering flashing cap strip, waterproof self-adhering end lap connector cap sheet, waterproof self-adhering corner end lap connector cap sheet, and installation procedures of the subject invention utilizing the flashing cap strip, end lap connector cap sheet, and corner end lap connector cap sheet assemblies of the subject invention enable flashings for a cap sheet layer of a roofing system, connections between successive lengths of cap sheets for a cap sheet layer of a roofing system, and corner flashings including the connection of flashing cap strips at the corner for a cap sheet layer of a roofing system to be easily, quickly, and effectively formed without a need for an installer to apply heat, heat sink granules, or use a secondary adhesive.

The waterproof self-adhering flashing cap strips, end lap connector cap sheets, and corner end lap connector cap sheets of the subject invention include a reinforcing layer encapsulated within self-adhering bitumen. The self-adhering bitumen forms the bottom major surfaces of the waterproof self-adhering flashing cap strips, end lap connector cap sheets, and corner end lap connector cap sheets. The top major surfaces of the waterproof self-adhering flashing cap strips, the end lap connector cap sheets, and the corner end lap connector cap sheets have lateral edge portions formed by the self-adhering bitumen and a coated central portion that extends between the lateral edge portions. The waterproof self-adhering flashing cap strips are typically used to interconnect cap sheets at roof surface intersections in the formation of waterproof cap sheet layers of roofing systems. The waterproof self-adhering end lap connector cap sheets are typically used to connect lengths of successive cap sheets at the job site during the formation of waterproof cap sheet layers of roofing systems. The waterproof self-adhering corner end lap connector cap sheets are typically used to form flashings and connect flashing cap strips at roof corners during the formation of waterproof cap sheet layers of roofing systems.

The flashing cap strip assemblies, end lap connector cap sheet, and corner end lap connector cap sheet assemblies of the subject invention are used in the method of the subject invention to form flashings at roof surface intersections, to connect lengths of cap sheets at the job site, and to connect cap sheets and form flashings at corners of a roof. The flashing cap strip assemblies, the end lap connector cap sheet assemblies, and the corner end lap connector cap sheet assemblies of the subject invention include release sheets that overlie the self-adhering bitumen forming the bottom major surfaces and top lateral edge portions of the waterproof self-adhering flashing cap strips, the waterproof self-adhering end lap connector cap sheets, and the waterproof self-adhering corner end lap connector cap sheets of the assemblies. The release sheets help to protect the self-adhering bitumen forming these surfaces from degradation and from adhering to other surfaces during storage, shipping and handling and are removed immediately prior to the installation of the waterproof self-adhering flashing cap strips, the waterproof self-adhering end lap connector cap sheets, and the waterproof self-adhering corner end lap connector cap sheets in accordance with the method of the subject invention.

Preferably, the roofing system of the subject invention provides a self-adhered roof system that when tested in accordance with ASTM Test E 108 meets Factory Mutual requirements for a Class A rated roof system and when tested in accordance with UL Test 790 meets the requirements of Underwriters Laboratories, Inc. for a Class A rated roof system.

In this specification and claims, a "self-adhering surface" or a "self-adhering top or bottom major surface" of a roof component, such as a base sheet, a cap sheet, a flashing cap strip, an end lap connector cap sheet, or a corner end lap connector cap sheet, is a surface that, primarily with the application of pressure, forms a watertight bond with the surface of another roof component without the need to use heat, flame, an additional adhesive material, or hot asphalt material. In this specification and claims, a "self-adhering" roof component, such as a self-adhering flashing cap strip, a self-adhering base sheet, a self-adhering cap sheet, a self-adhering end lap connector cap sheet, or a self-adhering corner end lap connector cap sheet, is a roof component that includes at least one self-adhering surface and/or self-adhering major surface.

BRIEF DESCRIPTION OF THE DRAWINGS

FIG. 11 is a schematic perspective view of an end lap connector cap sheet assembly of the subject invention.

FIG. 12 is a schematic top view of a waterproof self-adhering end lap connector cap sheet of the subject invention.

FIG. 13 is a partial schematic transverse cross section, on a larger scale than FIG. 12, taken substantially along lines 13-13 of FIG. 12.

FIG. 14 is an exploded schematic side view of the end portions (head laps) of two lengths of cap sheet connected by the waterproof self-adhering end lap connector cap sheet of the subject invention.

FIG. 15 is a schematic perspective view of a corner end lap connector cap sheet assembly of the subject invention.

FIG. 16 is a schematic top view of a waterproof self-adhering corner end lap connector cap sheet of the subject invention.

FIG. 17 is a partial schematic transverse cross section, on a larger scale than FIG. 16, taken substantially along lines 17-17 of FIG. 16.

DESCRIPTION OF THE PREFERRED EMBODIMENTS

Figure 1:
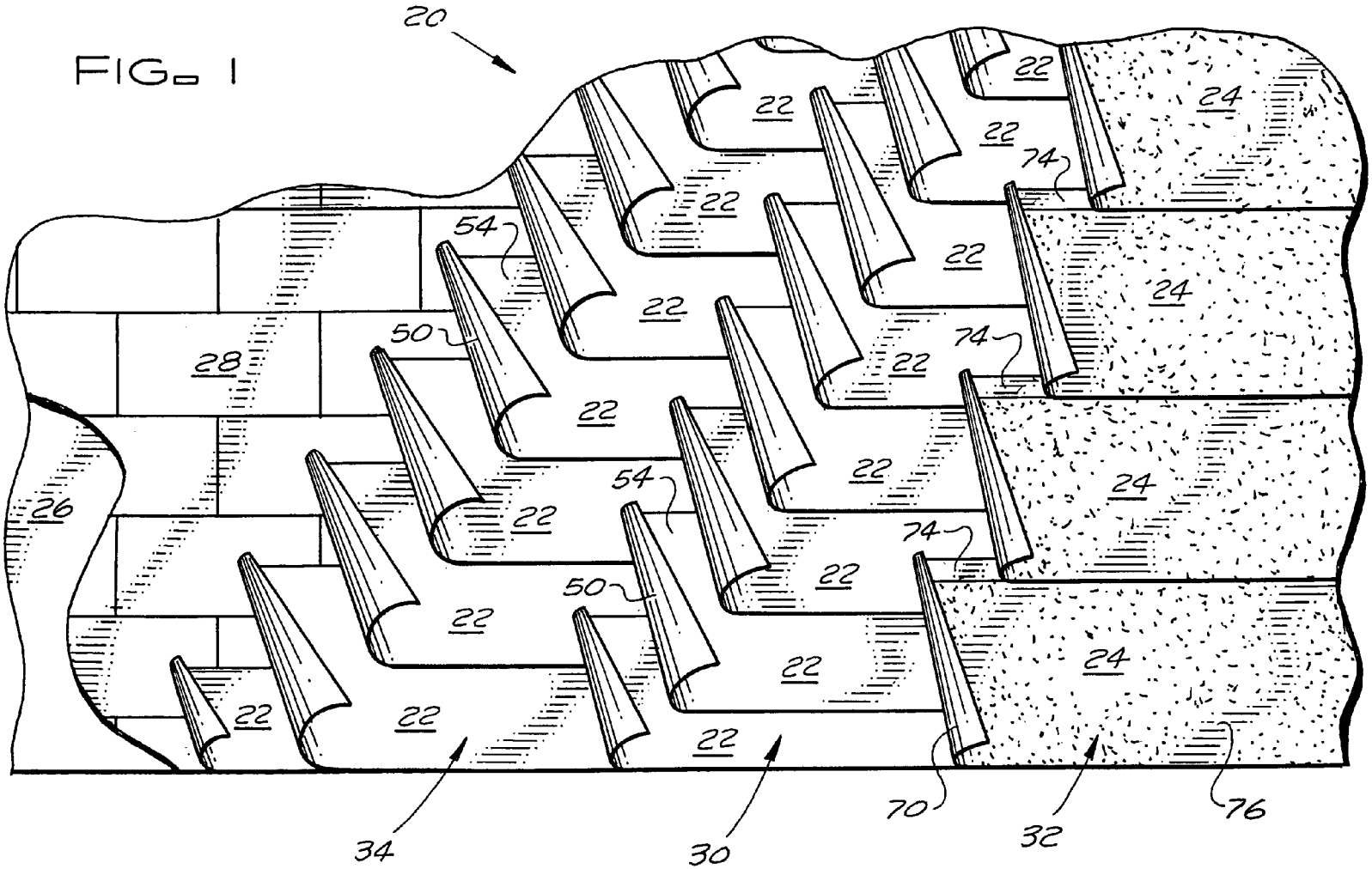
FIG. 1 is a partial schematic view, from above, of a field portion of a self-adhered roofing system that may utilize the self-adhering flashing cap strip of the subject invention at roof surface intersections of the roofing system, the self-adhering end lap connector cap sheet of the subject invention to connect successive lengths of cap sheet used in the roofing system, and the self-adhering end lap connector cap sheet at corners of the roofing system. The view has portions broken away to better show certain of the roofing system components.

As shown in FIG. 1, the field portion of a self-adhered roofing system 20 of the subject invention includes waterproof self-adhering base sheets 22 and cap sheets 24 that, preferably, are waterproof fire-retardant cap sheets. The waterproof self-adhering base sheets 22 of the roofing system 20 are self-adhered by watertight bonds both to each other to form inner roofing system layers and to underlying and overlying layers of the roofing system. The waterproof fire-retardant cap sheets 24 may be either self-adhering or non self-adhering. The non self-adhering waterproof fire-retardant cap sheets 24 are more fire-retardant than the self-adhering fire-retardant cap sheets. When non self-adhering waterproof fire-retardant cap sheets are utilized, the cap sheets 24 are adhered to each other, e.g. by a cold applied adhesive, and are adhered to an underlying layer formed of the self-adhering base sheets 22 by the self adhering top major surfaces of the self-adhering base sheets.

In a preferred embodiment of the invention, the exposed top layer of the self-adhered roofing system 20 is formed by the waterproof fire-retardant cap sheets 24 and the inner roofing system layers of the self-adhered roof system 20 are formed by: one or more layers of the waterproof self-adhering base sheets 22 and a roof deck 26; or one or more layers of the waterproof self-adhering base sheets 22, one or more insulation layers 28, and a roof deck 26. In addition to the one or more inner roofing system layers formed by the waterproof self-adhering base sheets 22, for certain applications, the lowermost layer of the self-adhered roofing system 20, formed by the self-adhering base sheets 22, may be self-adhered to an inner layer formed of conventional base sheets that are in turn bonded by a conventional hot or cold applied adhesive to a roof deck 26 or an insulation layer 28.

Each self-adhering inner layer of the self-adhered roofing system 20 is formed by a plurality of overlapping waterproof base sheets 22 that are self-adhered to the other base sheets of the self-adhering inner layer to form the self-adhering inner layer. In addition, the self-adhering base sheets 22 of the self-adhering inner layer thus formed are self adhered to overlying and underlying layers of the self-adhered roofing system. As shown in FIG. 1, a self-adhering layer 30 of self-adhering base sheets 22 is self-adhered to an overlying outer layer 32 of the fire-retardant cap sheets 24 and an underlying inner layer 34 of self-adhering base sheets 22 or conventional base sheets. Where the underlying layer 34 is also formed of self-adhering base sheets 22, the underlying layer may be self-adhered to the insulation layer 28, as shown in FIG. 1, to another base sheet layer, or directly to the roof deck 26. The roof deck 26 may be a wood, metal or concrete roof deck.

Figure 2:
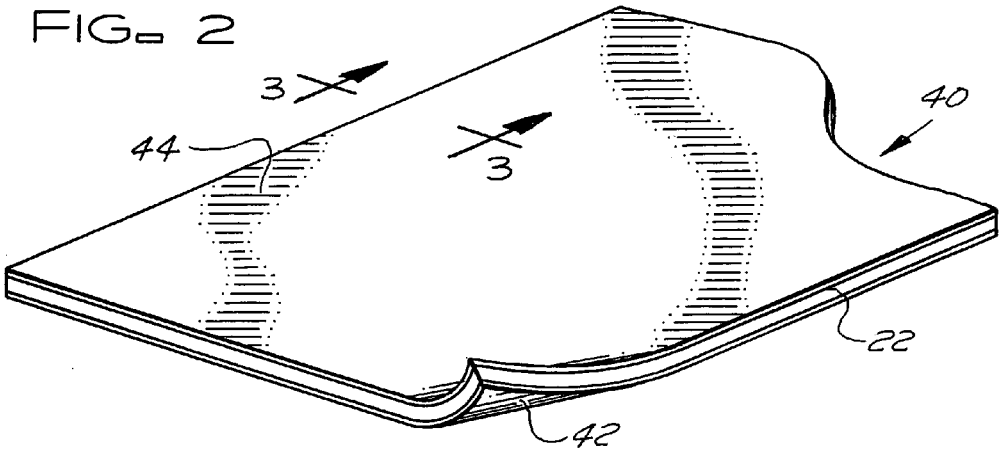
FIG. 2 is a partial schematic perspective view of a base sheet assembly that may be used in the self-adhering roofing system of the subject invention.
Figure 3:
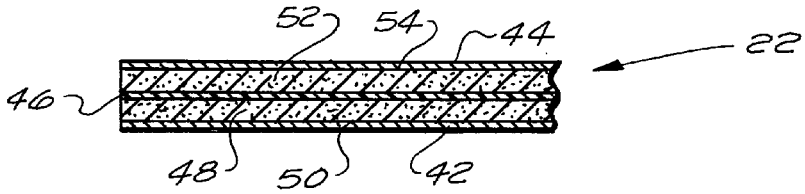
FIG. 3 is a transverse cross section through the base sheet assembly of FIG. 2 taken substantially along lines 3-3 of FIG. 2.

As shown in FIGS. 2 and 3, the base sheet assembly 40 of the subject invention has: a waterproof self-adhering base sheet 22, a bottom surface release sheet 42 that forms a bottom surface of the base sheet assembly, and a top surface release sheet 44 that forms a top surface of the base sheet assembly. With the release sheets 42 and 44 of the base sheet assembly removed, the waterproof base sheet 22 can be self-adhered to other waterproof self-adhering base sheets 22 to form a watertight roofing system layer and to an overlying roofing system layer and an underlying roofing system layer.

The waterproof self-adhering base sheet 22 of the base sheet assembly 40 may be of various lengths, widths, and thicknesses, but preferably is about 30 to about 60 feet long, about 39 inches wide (typically 39⅜ inches wide), and between about 0.04 and about 0.16 inches thick (about 10 to about 20 meters long, 880 to 1020 millimeters wide, and between about 1 and about 4 millimeters thick). The waterproof self-adhering base sheet has a reinforcing layer 46 encapsulated within self-adhering bitumen. The self-adhering bitumen of the waterproof self-adhering base sheet 22 forms a bottom layer 48 and a bottom major surface 50 of the waterproof self-adhering base sheet and a top layer 52 and a top major surface 54 of the waterproof self-adhering base sheet. The bottom major surface 50 and the top major surface 54 of the waterproof self-adhering base sheet 22 are self-adhering surfaces free of surfacing materials such as talc, sand, polymeric films, or other non-adhesive materials.

The reinforcing layer 46 of the waterproof self-adhering base sheet 22 is typically a non-woven polyester, fiberglass, or polyester/fiberglass reinforcement mat. The modified bitumen is bitumen modified to be a self-adhering material. An example of modified bitumen that can be used in the waterproof self-adhering base sheet 22 has the following composition: 40% to 75% by weight asphalt having a penetration when tested @ 25° C. per ASTM D5 of 40 to 200 dmm and a Ring & Ball Softening Point of 20° to 80° C. when tested per ASTM D36; 0% to 14% by weight Styrene-Butadiene-Styrene (SBS) radical polymer; 0% to 14% by weight Styrene-Butadiene (SB) Diblock polymer; 0% to 20% by weight Colemanite; 0% to 20% by weight Dolomite containing approximately 20% to 30% magnesium carbonate; 0% to 20% by weight Calcium Carbonate; 0.5% to 15% by weight hydrocarbon resin; 0% to 15% by weight Severely Hydrotreated Napthenic Process Oil; and 0% to 0.5% by weight anti-oxidant. The asphalt used in the modified self-adhering bitumen may be, but is not limited to, asphalt marketed by Phillips Conoco Wood River under the trade designation PG58-22. The Styrene-Butadiene-Styrene (SBS) radical polymer used in the modified self-adhering bitumen may be, but is not limited to, Styrene-Butadiene-Styrene (SBS) radical polymer marketed by Polimieri Europa under the trade designation 161B. The Styrene-Butadiene (SB) Diblock polymer used in the modified self-adhering bitumen may be, but is not limited to, Styrene-Butadiene (SB) Diblock polymer marketed by Polimieri Europa under the trade designation 6320. The Dolomite used in the modified self-adhering bitumen may be, but is not limited to, Dolomite marketed by Global Filler Products under the trade designation GFP 250. The Calcium Carbonate used in the modified self-adhering bitumen may be, but is not limited to, Calcium Carbonate marketed by Huber under the trade designation Q 200. The hydrocarbon resin used in the modified self-adhering bitumen may be, but is not limited to, hydrocarbon resin marketed by Sunbelt under the trade designation SB2296. The Severely Hydrotreated Napthenic Process Oil used in the modified self-adhering bitumen may be, but is not limited to, Severely Hydrotreated Napthenic Process marketed by Ergon Refining under the trade designation Hygard L 750.

The bottom surface release sheet 42 of the base sheet assembly 40 may be a conventional release sheet, such as but not limited to, a polymeric or paper sheet having one or both major surfaces treated with silicone or another a suitable release agent. The bottom surface release sheet 42 overlies and is coextensive with or substantially coextensive with the bottom major surface 50 of the waterproof self-adhering base sheet 22 to protect the self-adhering bottom major surface 50 of the waterproof self-adhering base sheet from damage or degradation, such as but not limited to the accumulation of dust or other non-adhesive materials on the surface during storage, shipment and handling. The bottom surface release sheet 42 is removable from the bottom major surface 50 of the waterproof self-adhering base sheet 22 immediately prior to installation of the waterproof self-adhering base sheet on an underlying layer of a roof system. With the bottom surface release sheet 42 removed from the bottom major surface 50 of the waterproof self-adhering base sheet 22, the bottom major surface of the waterproof self-adhering base sheet may be self-adhered by a watertight bond to an underlying roofing system layer primarily by the application of pressure.

The top surface release sheet 44 of the base sheet assembly 40 may be a conventional release sheet, such as but not limited to, a polymeric or paper sheet having one or both major surfaces treated with silicone or another a suitable release agent. The top surface release sheet 44 overlies and is substantially coextensive with the top major surface 54 of the waterproof self-adhering base sheet 22 to protect the self-adhering top major surface of the waterproof self-adhering base sheet from damage or degradation, such as but not limited to the accumulation of dust or other non-adhesive materials on the surface during storage, shipment and handling. The top surface release sheet 44 is removable from the top major surface 54 of the waterproof self-adhering base sheet 22 immediately prior to an application of an overlying roof layer to the top major surface of the waterproof self-adhering base sheet. With the top surface release sheet 44 removed from the top major surface 54 of the waterproof self-adhering base sheet 22, the top major surface 54 the waterproof self-adhering base sheet may be self-adhered by a watertight bond to an overlying roofing system layer primarily by the application of pressure.

Figure 4:
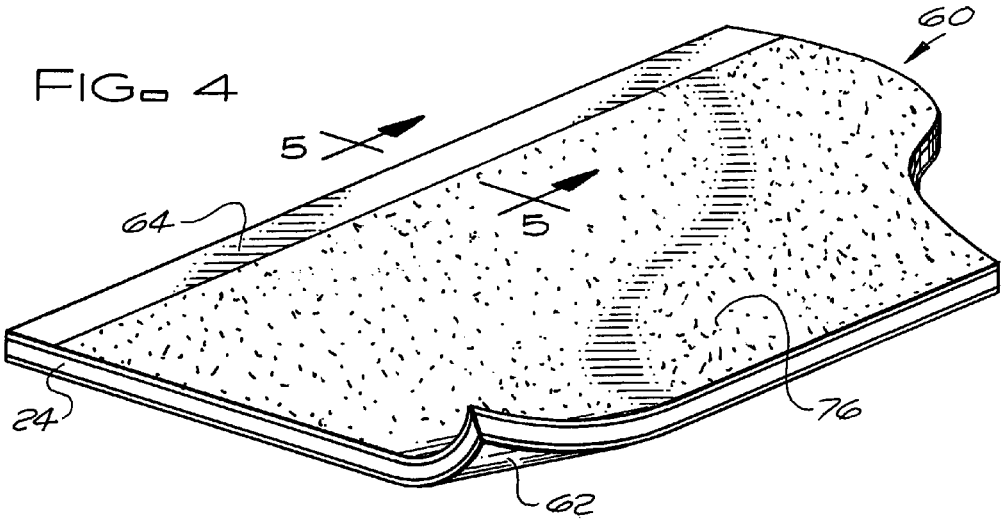
FIG. 4 is a partial schematic perspective view of a cap sheet assembly that may be used in the self-adhering roofing system of the subject invention.
Figure 5:
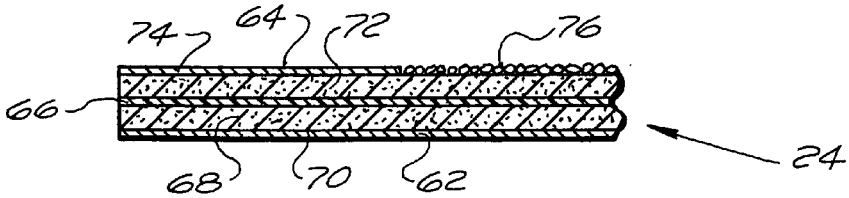
FIG. 5 is a transverse cross section through the cap sheet assembly of FIG. 4 taken substantially along lines 5-5 of FIG. 4.

As shown in FIGS. 4 and 5, the cap sheet assembly 60 of the subject invention has: a waterproof fire-retardant cap sheet 24, a bottom surface release sheet 62 that forms a bottom surface of the cap sheet assembly, and a top surface selvage edge portion release sheet 64 that forms one lateral edge portion of a top surface of the cap sheet assembly. With the bottom release sheet 62 of the cap sheet assembly removed, the waterproof fire-retardant cap sheet 24 can be adhered to an underlying roofing system layer formed by a plurality of the waterproof self-adhering base sheets 22 by pressing the cap sheet 24 against the self-adhering surface of the underlying roof system layer formed by the waterproof self-adhering base sheets 22. With the top surface selvage edge portion release sheet 64 removed, the selvage edge portion of the cap sheet 24 may be bonded to an overlapping lateral edge portion of another cap sheet to form a watertight topmost layer of a roof system. Where the waterproof cap sheet 24 is a self-adhering cap sheet, the bond between the overlapped lateral edge portions of the cap sheets is effected primarily by the application of pressure. Where the waterproof cap sheet 24 is a non self-adhering cap sheet, the bond between the overlapped lateral edge portions of the cap sheets may be effected by the application of pressure and heat, a cold applied adhesive, sealing tape, etc.

The waterproof fire-retardant cap sheet 24 of the cap sheet assembly 60 may be of various lengths, widths, and thicknesses, but preferably, is about 30 to about 45 feet long, about 39 inches wide (typically 39⅜ inches wide), and between about 0.08 and about 0.20 inches thick (about 10 to about 15 meters long, 880 to 1020 millimeters wide, and between about 2 and about 5 millimeters thick). The waterproof fire-retardant cap sheet 24 has a reinforcing layer 66 encapsulated within modified bitumen. The modified bitumen forms a bottom layer 68 and a bottom major surface 70 of the waterproof fire-retardant cap sheet 24. The modified bitumen also forms a top layer 72 and a selvage edge portion surface 74 of the top major surface of the waterproof fire-retardant cap sheet. The selvage edge portion surface 74 of the top major surface of the waterproof fire-retardant cap sheet 24 is between about 3 inches and about 13 inches wide and preferably about 8 inches wide (between about 75 and about 320 millimeters wide and preferably about 200 millimeters wide) and extends along one lateral edge of the cap sheet for the entire length of the cap sheet. The remainder 76 of the top major surface of the waterproof fire-retardant cap sheet 24 is surfaced with a conventional surfacing material such as but not limited to roofing granules, sand, or other coating materials. The bottom major surface 70 and the selvage edge portion 74 of the top major surface of the waterproof fire-retardant cap sheet 24 are free of surfacing materials such as talc, sand, polymeric films or other non-adhesive materials to facilitate the bonding of the bottom major surface 70 of the cap sheet to an underlying roofing system layer of self-adhering base sheets 22 and the selvage edge portion surface 74 of the cap sheet to an overlapping lateral edge portion of another cap sheet.

The reinforcing layer 66 of the waterproof fire-retardant cap sheet 24 is typically a non-woven polyester, fiberglass, or polyester/fiberglass reinforcement mat. Where the waterproof fire-retardant cap sheet 24 is a self-adhering embodiment of the cap sheet, the modified bitumen of the cap sheet may be the same as that specified above for the self-adhering base sheets 22. Where the waterproof fire-retardant cap sheet 24 is non self-adhering to provide an embodiment of the cap sheet that is more fire-retardant than the self-adhering embodiment of the cap sheet 24, the modified bitumen is bitumen, modified with fire-retardant materials, polymers, fillers and additives, to be a fire-retardant material. An example of modified bitumen that can be used in the non self-adhering embodiment of the waterproof fire-retardant cap sheet 24 has the following composition: 40% to 75% by weight asphalt having a penetration when tested @ 25° C. per ASTM D5 of 40 to 200 Dmm and a Ring & Ball Softening Point of 200 to 80° C. when tested per ASTM D36; 4% to 12% by weight Styrene-Butadiene-Styrene (SBS) radical polymer; 10% to 35% by weight Colemanite; 10% to 30% by weight Dolomite containing approximately 20% to 30% magnesium carbonate; 0% to 10% by weight Calcium Carbonate; and 0% to 0.5% by weight anti-oxidant. The asphalt used in the modified fire-retardant bitumen may be, but is not limited to, asphalt marketed by Phillips Conoco Wood River under the trade designation PG58-22. The Styrene-Butadiene-Styrene (SBS) radical polymer used in the modified fire-retardant bitumen may be, but is not limited to, Styrene-Butadiene-Styrene (SBS) radical polymer marketed by Polimieri Europa under the trade designation 161B. The Dolomite used in the modified self-adhering bitumen may be, but is not limited to, Dolomite marketed by Global Filler Products under the trade designation GFP 250. The Calcium Carbonate used in the modified self-adhering bitumen may be, but is not limited to, Calcium Carbonate marketed by Huber under the trade designation Q 200.

The bottom surface release sheet 62 of the cap sheet assembly 60 may be a conventional release sheet, such as but not limited to, a polymeric or paper sheet having one or both major surfaces treated with silicone or another a suitable release agent. The bottom surface release sheet 62 overlies and is coextensive with or substantially coextensive with the bottom major surface 70 of the waterproof fire-retardant cap sheet 24 to protect the bottom major surface of the waterproof fire-retardant cap sheet from damage or degradation, such as but not limited to, the accumulation of dust or other non-adhesive materials on the surface during storage, shipment and handling that would inhibit the bonding of the surface to an inner layer of self-adhering base sheets 22. The bottom surface release sheet 62 is removable from the bottom major surface 70 of the waterproof fire-retardant cap sheet immediately prior to installation of the waterproof fire-retardant cap sheet on an underlying self-adhering roofing system layer formed by a plurality of the waterproof self-adhering base sheets 22 to form a watertight bond with the underlying roofing system layer primarily by the application of pressure.

The top selvage edge portion release sheet 64 may be a conventional release sheet, such as but not limited to, a polymeric or paper sheet having one or both major surfaces treated with silicone or another a suitable release agent. The top surface selvage edge portion release sheet 64 overlies and is coextensive with or substantially coextensive with the selvage edge portion surface 74 of the top major surface of the waterproof fire-retardant cap sheet 24 to protect the selvage edge portion of the top major surface of the waterproof fire-retardant cap sheet from damage or degradation, such as but not limited to, the accumulation of dust or other non-adhesive materials on the surface during storage, shipment and handling. The top selvage edge portion release sheet 64 is removable from the selvage edge portion 74 of the top major surface of the waterproof fire-retardant cap sheet 24 immediately prior to an application and bonding of an overlapping lateral edge portion of an adjacent cap sheet to the selvage edge portion 74 of the top major surface of the waterproof fire-retardant cap sheet to form a watertight bond with the overlapping portion of the adjacent cap sheet. Where the cap sheet 24 is a self-adhering cap sheet, the bottom major surface of the cap sheet and the selvage edge portion surface of the cap sheet are self-adhering surfaces.

Figure 6:
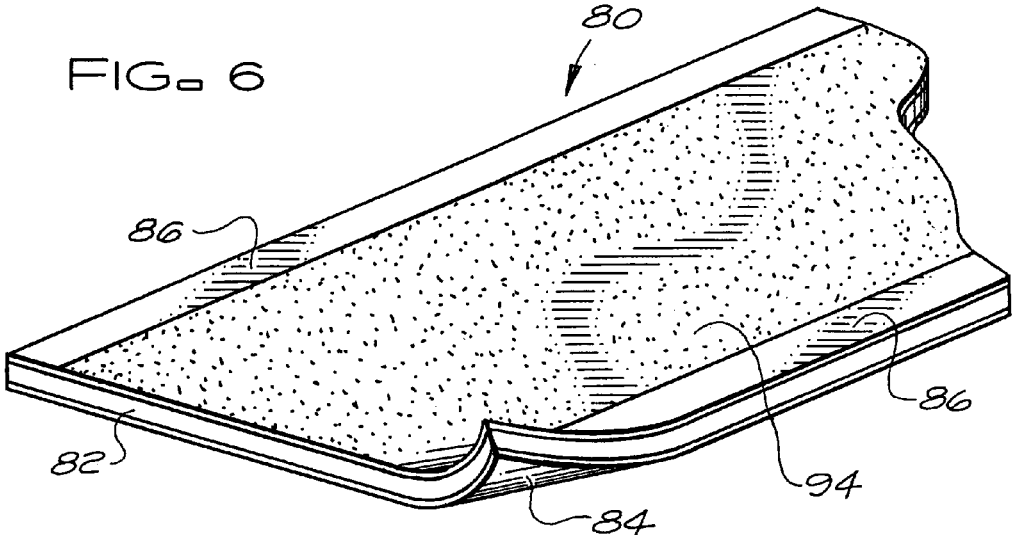
FIG. 6 is a schematic perspective view of a portion of a flashing cap strip assembly of the subject invention.
Figure 7:
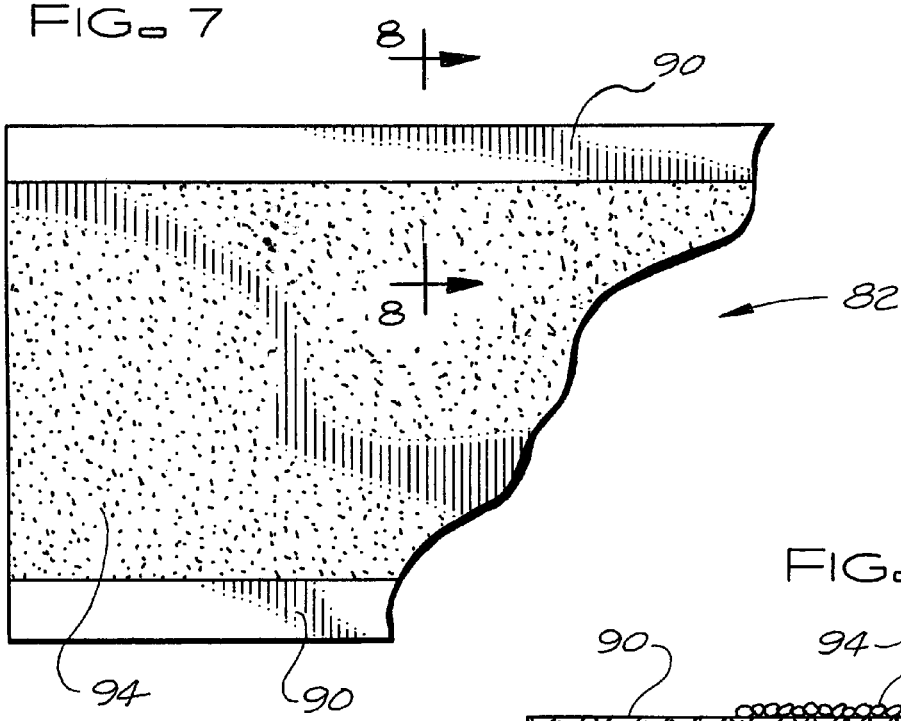
FIG. 7 is a schematic top view of a portion of a length of a waterproof self-adhering flashing cap strip of the subject invention.
Figure 8:
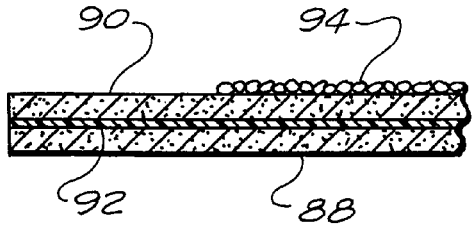
FIG. 8 is a schematic partial transverse cross section, on a larger scale than FIG. 7, taken substantially along lines 8-8 of FIG. 7.

As shown in FIGS. 6 to 8, the flashing cap strip assembly 80 of the subject invention has: a waterproof fire-retardant self-adhering flashing cap strip 82, a bottom surface release sheet 84 that forms a bottom surface of the flashing cap strip assembly, and two top surface lateral edge portion release sheets 86 that form the lateral edge portions of a top surface of the flashing cap strip assembly. With the bottom release sheet 84 of the flashing cap strip assembly removed, the self-adhering bottom major surface 88 of the waterproof fire-retardant self-adhering flashing cap strip 82 can be adhered to an underlying roofing system layer, preferably formed by a plurality of the waterproof self-adhering base sheets 22, by pressing the self-adhering flashing cap strip 82 against the top surface of the underlying roofing system layer. With the top surface lateral edge portion release sheets 86 removed, the self-adhering lateral edge portion surfaces 90 of the self-adhering flashing cap strip 82 may be bonded to the overlapping lateral edge portions of adjacent cap sheets 24 to form a watertight topmost layer of a roofing system and the bond between the self-adhering flashing cap strip 82 and the adjacent cap sheets 24 can be effected primarily by the application of pressure. Heat, a cold applied adhesive, sealing tape, etc. do not have to be used to effect the watertight bond between the self-adhering flashing cap strip 82 and the adjacent cap sheets 24.

The waterproof self-adhering flashing cap strip 82 of the flashing cap strip assembly 80 may be of various lengths, widths, and thicknesses, but preferably, is about 30 to about 45 feet long, about 39 inches wide (typically 39⅜ inches wide), and between about 0.08 to about 0.20 inches thick (about 10 to about 15 meters long, 880 to 1020 millimeters wide, and between about 2 and about 5 millimeters thick). The waterproof fire-retardant flashing cap strip 82 has a reinforcing layer 92 encapsulated within modified bitumen. The modified bitumen forms a bottom layer and the self-adhering bottom major surface 88 of the waterproof fire-retardant flashing cap strip 82. The modified bitumen also forms an upper layer and the top self-adhering surfaces 90 of the lateral edge portions of the top major surface of the waterproof fire-retardant flashing cap strip 82. The lateral edge portion self-adhering surfaces 90 of the top major surface of the waterproof fire-retardant flashing cap strip 82 are each between about 3 inches and about 13 inches wide and preferably about 8 inches wide (between about 75 and about 320 millimeters wide and preferably about 200 millimeters wide) and the surfaces extend along the lateral edges of the flashing cap strip for the entire length of the flashing cap strip. The remainder 94 of the top major surface of the waterproof fire-retardant flashing cap strip 82 is surfaced with a conventional surfacing material such as but not limited to roofing granules, sand, or other coating materials. The bottom major surface 88 and the surfaces 90 of the lateral edge portions of the top major surface of the waterproof fire-retardant flashing cap strip 82 are free of surfacing materials such as talc, sand, polymeric films or other non-adhesive materials to facilitate the bonding of the self-adhering bottom major surface 88 of the flashing cap strip to an underlying roofing system layer of base sheets (preferably, self-adhering base sheets 22) and the lateral edge portion self-adhering surfaces 90 of the flashing cap strip to overlapping lateral edge portions of adjacent cap sheets that form, with the flashing cap strip, a flashing of the cap sheet layer.

The reinforcing layer 92 of the waterproof fire-retardant flashing cap strip 82 is typically a non-woven polyester, fiberglass, or polyester/fiberglass reinforcement mat. The self-adhering modified bitumen of the waterproof self-adhering flashing cap strip 82 may be the same as that specified above for the self-adhering base sheets 22.

Figure 9:
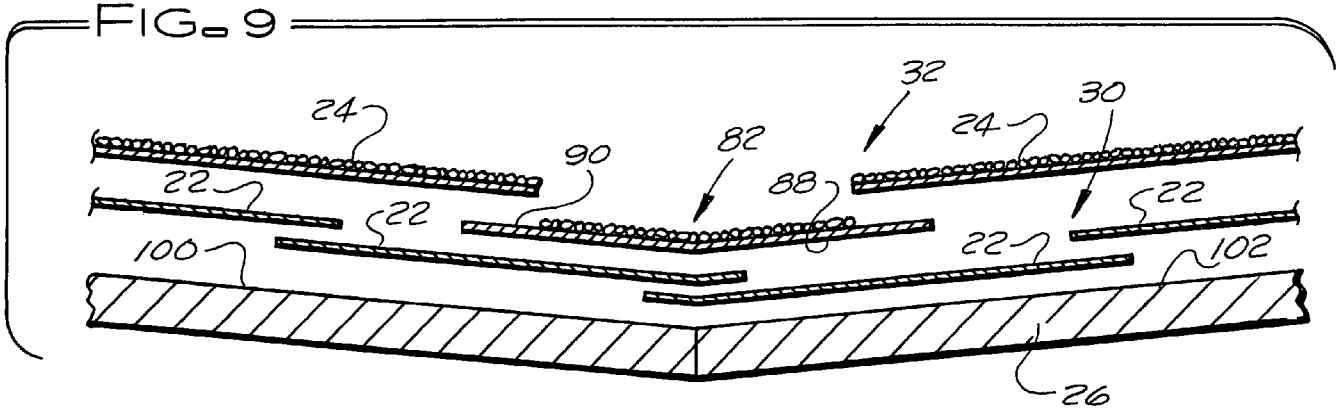
FIG. 9 is an exploded schematic transverse cross section through a flashing, utilizing the waterproof self-adhering flashing cap strip of the subject invention, which is located at a roof surface intersection forming a valley in a roofing system of the subject invention.

FIG. 9 is a detail of a roofing system of the subject invention at an interruption in the roof deck 26 formed by a marked change in the slope or direction of the roof deck. The interruption shown in FIG. 9 is a roof deck valley that is formed by intersecting first and second roof deck surfaces 100 and 102 of the roof deck 26. As shown, the planes of the first and second roof deck surfaces 100 and 102 intersect at an angle that is less than 90°. At least one base sheet layer 30 of base sheets, preferably formed by self-adhering base sheets 22, overlies and is bonded or otherwise secured to the roof deck 26 or an insulation layer to form the waterproof base sheet layer 30 of the roofing system. The waterproof self-adhering flashing cap strip 82 overlies the interruption in the roof deck 26 formed by the intersection of the roof deck surfaces 100 and 102 (the lowest portion of the roof valley) and extends outward from both sides of the interruption in the roof deck 26 to form, with adjacent cap sheets 24 extending up each slope of the valley, a flashing of the cap sheet layer 32 of the roofing system. Preferably, the longitudinal centerline of the waterproof self-adhering flashing cap strip 82 is aligned with or substantially aligned with and extends along the length of the interruption formed by the intersecting roof deck surfaces 100 and 102. The waterproof self-adhering flashing cap strip 82 is bonded by a watertight bond to the underlying base sheet layer 30 by the self-adhering bitumen bottom surface 88 of the waterproof self-adhering flashing cap strip and, where the roofing base sheet layer is made of self-adhering base sheets 22, by the self-adhering bitumen top surface of the base sheet layer. The bonding of the waterproof self-adhering flashing cap strip 82 to the underlying base sheet layer 30 is effected primarily by the application of pressure to the waterproof self-adhering flashing cap strip and no heat or secondary adhesive is required to effect the bond.

The lateral edge portions of the adjacent cap sheets 24 overlap and are bonded by watertight bonds to the top self-adhering surfaces 90 of the lateral edge portions of the self-adhering flashing cap strip 82. Where the adjacent cap sheets 24 are non self-adhering cap sheets, the watertight bonds between the top self-adhering surfaces 90 of the lateral edge portions of the self-adhering flashing cap strip 82 and bottom surfaces of the lateral edge portions of the cap sheets 24 are formed preferably solely by the self-adhering bitumen top surfaces 90 of the lateral edge portions of the waterproof self-adhering flashing cap strip. Where the adjacent cap sheets 24 are self-adhering cap sheets 22, the watertight bonds between the lateral edge portions of the self-adhering flashing cap strip 82 and the adjacent cap sheets 24 are preferably formed solely by the self-adhering bitumen top surfaces 90 of the lateral edge portions of the waterproof self-adhering flashing cap strip and the self-adhering bottom surfaces of the lateral edge portions of the adjacent cap sheets 24. The bonding of the top self-adhering surfaces 90 of the lateral edge portions of the waterproof self-adhering flashing cap strip 82 to the overlying lateral edge portions of the adjacent cap sheets 24 is effected primarily by the application of pressure and no heat or secondary adhesive is required to effect the bond.

Figure 10:
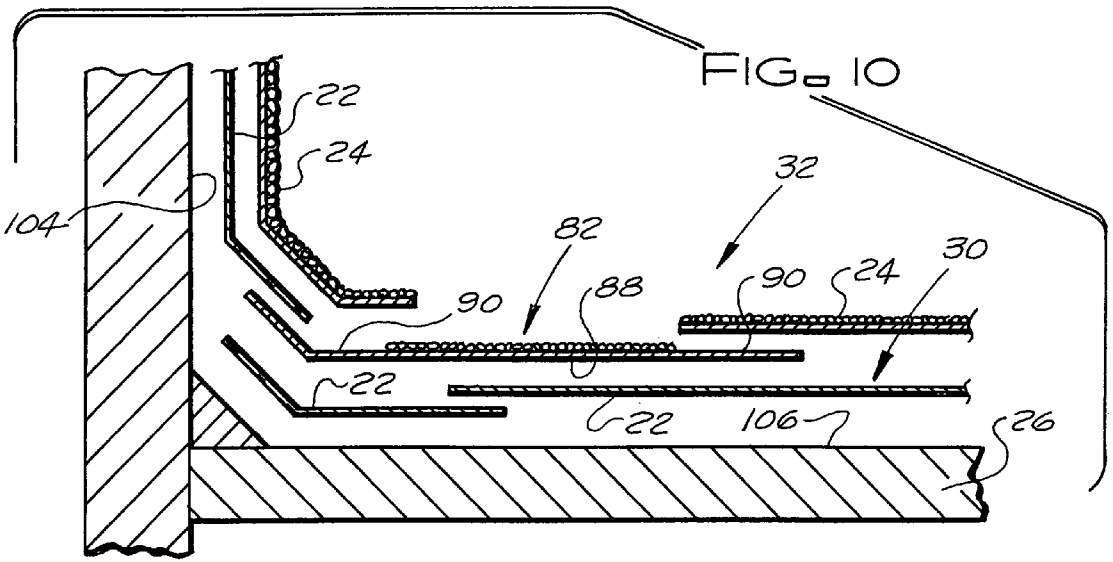
FIG. 10 is an exploded schematic transverse cross section through a flashing, utilizing the waterproof self-adhering flashing cap strip of the subject invention, which is located at a roof surface intersection formed by a flat roof deck and a wall surface projecting upward from the deck at substantially right angles.

FIG. 10 is a detail of a roofing system of the subject invention at an interruption in the roof deck 26 formed by a marked change in the slope or direction of the roof deck. The interruption shown in FIG. 10 is a wall surface 104 intersecting and projecting upward from a generally flat surface 106 of the roof deck 26 or insulation layer surfaces. As shown, the planes of the wall surface 104 and the flat roof deck surface 106 or insulation surfaces intersect at an angle that is 90° or substantially 90°. At least one base sheet layer 30 of base sheets, preferably formed by self-adhering base sheets 22, overlies and is bonded or otherwise secured to the wall surface 104 and the generally flat roof deck surface 106 or insulation layer surface of the roof deck 26 to form part of the waterproof roofing layer 30. The waterproof self-adhering flashing cap strip 82 overlies the interruption in the roof deck 26 formed by the intersection of the roof deck wall surfaces 104 and 106 and extends outward from both sides of the interruption in the roof deck 26 to form, with adjacent cap sheets 24, a portion of the cap sheet layer 32 of the roofing system. Preferably, the longitudinal centerline of the waterproof self-adhering flashing cap strip 82 extends generally parallel to and for the length of the interruption formed by the intersecting roof deck surfaces 104 and 106 or insulation layer surfaces. The waterproof self-adhering flashing cap strip 82 is bonded by a watertight bond to the underlying roofing base sheet layer 30 by the self-adhering bitumen bottom surface 88 of the waterproof self-adhering flashing cap strip and, where the roofing base sheet layer is made of self-adhering base sheets 22, by the self-adhering bitumen top surface of the base sheet layer. The bonding of the waterproof self-adhering flashing cap strip 82 to the underlying base sheet layer 30 is effected primarily by the application of pressure to the waterproof self-adhering flashing cap strip and no heat or secondary adhesive is required to effect the bond.

The lateral edge portions of the adjacent cap sheets 24 overlap and are bonded by watertight bonds to the top self-adhering surfaces 90 of the lateral edge portions of the self-adhering flashing cap strip 82. Where the adjacent cap sheets 24 are non self-adhering cap sheets, the watertight bonds between the top self-adhering surfaces 90 of the lateral edge portions of the self-adhering flashing cap strip 82 and bottom surfaces of the lateral edge portions of the cap sheets 24 are preferably formed solely the self-adhering bitumen top surfaces 90 of the lateral edge portions of the waterproof self-adhering flashing cap strip. Where the cap sheets 24 are self-adhering cap sheets 22, the watertight bonds between the lateral edge portions of the self-adhering flashing cap strip 82 and the cap sheets 24 are preferably formed solely the self-adhering bitumen top surfaces 90 of the lateral edge portions of the waterproof self-adhering flashing cap strip and the self-adhering bottom surfaces of the lateral edge portions of the cap sheet 24. The bonding of the top surfaces 90 of the lateral edge portions of the waterproof self-adhering flashing cap strip 82 to the overlying lateral edge portions of the cap sheets 24 is effected primarily by the application of pressure and no heat or secondary adhesive is required to effect the bond.

As shown in FIGS. 11 to 13, the end lap connector cap sheet assembly 110 of the subject invention has: a waterproof fire-retardant self-adhering end lap connector cap sheet 112, a bottom surface release sheet 114 that forms a bottom surface of the end lap connector cap sheet assembly, and three top surface edge portion release sheets 116 that form three of the edge portions of a top surface of the end lap connector cap sheet assembly. With the bottom release sheet 114 of the end lap connector cap sheet assembly removed, the self-adhering bottom major surface 118 of the waterproof fire-retardant self-adhering end lap connector cap sheet 112 can be adhered to an underlying roofing system layer, preferably formed by a plurality of the waterproof self-adhering base sheets 22, by pressing the waterproof self-adhering end lap connector cap sheet 112 against the top surface of the underlying roofing system layer. With the opposing top surface lateral edge portion release sheets 116 removed, the opposing top self-adhering surfaces 120 of the lateral edge portions of the waterproof self-adhering end lap connector cap sheet 112 may be bonded to overlapping end lap edge portions of successive lengths of cap sheet to form, at the job site and as shown in FIG. 14, a continuous length of cap sheet 24 from two separate lengths of cap sheet. The top self-adhering surface 120 of third self-adhering edge portion of the waterproof self-adhering end lap connecter cap sheet 112 forms, along with the top surfaces 74 of selvage edge portions of the cap sheets 24, a continuous self-adhering selvage edge portion surface for the joined cap sheets 24. The watertight bond between the self-adhering top surfaces 120 of the lateral edge portions of the end lap connector cap sheet 112 and the lengths of cap sheet 24 can be effected primarily by the application of pressure. Heat, a cold applied adhesive, sealing tape, etc. do not have to be used to effect the watertight bond between the self-adhering end lap connector cap sheet 112 and the lengths of cap sheet.

The waterproof self-adhering end lap connector cap sheet 112 of the end lap connector cap sheet assembly 110 may be of various lengths, widths, and thicknesses, but preferably, the self-adhering end lap connector cap sheet 112 is a square in shape with each side of the square having the same dimension as the width of the cap sheet 24. Currently cap sheets 24 are about 39⅜ inches in width (between 880 and 1020 millimeters in width) and, preferably, the waterproof self-adhering end lap connector cap sheet 112 is about 39⅜ inches long by about 39% wide (880 to 1020 millimeters long by 880 to 1020 millimeters wide) and between 0.08 and 0.40 inches thick (between about 2 and about 5 millimeters thick). The waterproof fire-retardant self-adhering end lap connector cap sheet 112 has a reinforcing layer 122 encapsulated within modified bitumen. The modified bitumen forms a bottom layer and the self-adhering bottom major surface 118 of the waterproof fire-retardant self-adhering end lap connector cap sheet 112. The modified bitumen also forms an upper layer and the self-adhering top surfaces 120 of the three self-adhering edge portions of the top major surface of the waterproof fire-retardant self-adhering end lap connector cap sheet 112. The self-adhering top surfaces 120 of lateral edge portions of the top major surface of the waterproof fire-retardant self-adhering end lap connector cap sheet 112 are each between about 3 inches and about 13 inches wide and preferably about 8 inches wide (between about 75 and about 320 millimeters wide and preferably about 200 millimeters wide) and the surfaces extend along the lateral edges of the self-adhering end lap connector cap sheet 112 for the entire length of the end lap connector cap sheet. The self-adhering top surface 120 of the third self-adhering edge portion of the top major surface of the waterproof fire-retardant self-adhering end lap connector cap sheet 112 is also between about 3 inches and about 13 inches wide and preferably about 8 inches wide (between about 75 and about 320 millimeters wide and preferably about 200 millimeters wide) and this third self-adhering surface extends along a third edge of the self-adhering end lap connector cap sheet 112 between the self-adhering surfaces 120 of the lateral edge portions of the end lap connector cap sheet 112. The remainder 124 of the top major surface of the waterproof fire-retardant self-adhering end lap connector cap sheet 112 is surfaced with a conventional surfacing material such as but not limited to roofing granules, sand, or other coating materials.

The self-adhering bottom major surface 118 and the self-adhering top surfaces 120 of the edge portions of the top major surface of the waterproof fire-retardant self-adhering end lap connector cap sheet 112 are free of surfacing materials such as talc, sand, polymeric films or other non-adhesive materials to facilitate the bonding of the self-adhering bottom major surface 118 of the end lap connector cap sheet 112 to an underlying roofing system layer of base sheets (preferably, self-adhering base sheets 22) and to facilitate the bonding of the self-adhering top surfaces 120 of edge portions of the end lap connector cap sheet to overlapping end edge portions of cap sheet lengths that will form a continuous cap sheet 24 with the end lap connector cap sheet and the formation of a self-adhering selvage edge portion for the connected cap sheet thus formed.

The reinforcing layer 122 of the waterproof fire-retardant self-adhering end lap connector cap sheet 112 is typically a non-woven polyester, fiberglass, or polyester/fiberglass reinforcement mat. The self-adhering modified bitumen of the waterproof self-adhering end lap connector cap sheet 112 may be the same as that specified above for the self-adhering base sheets 22.

Figure 18:
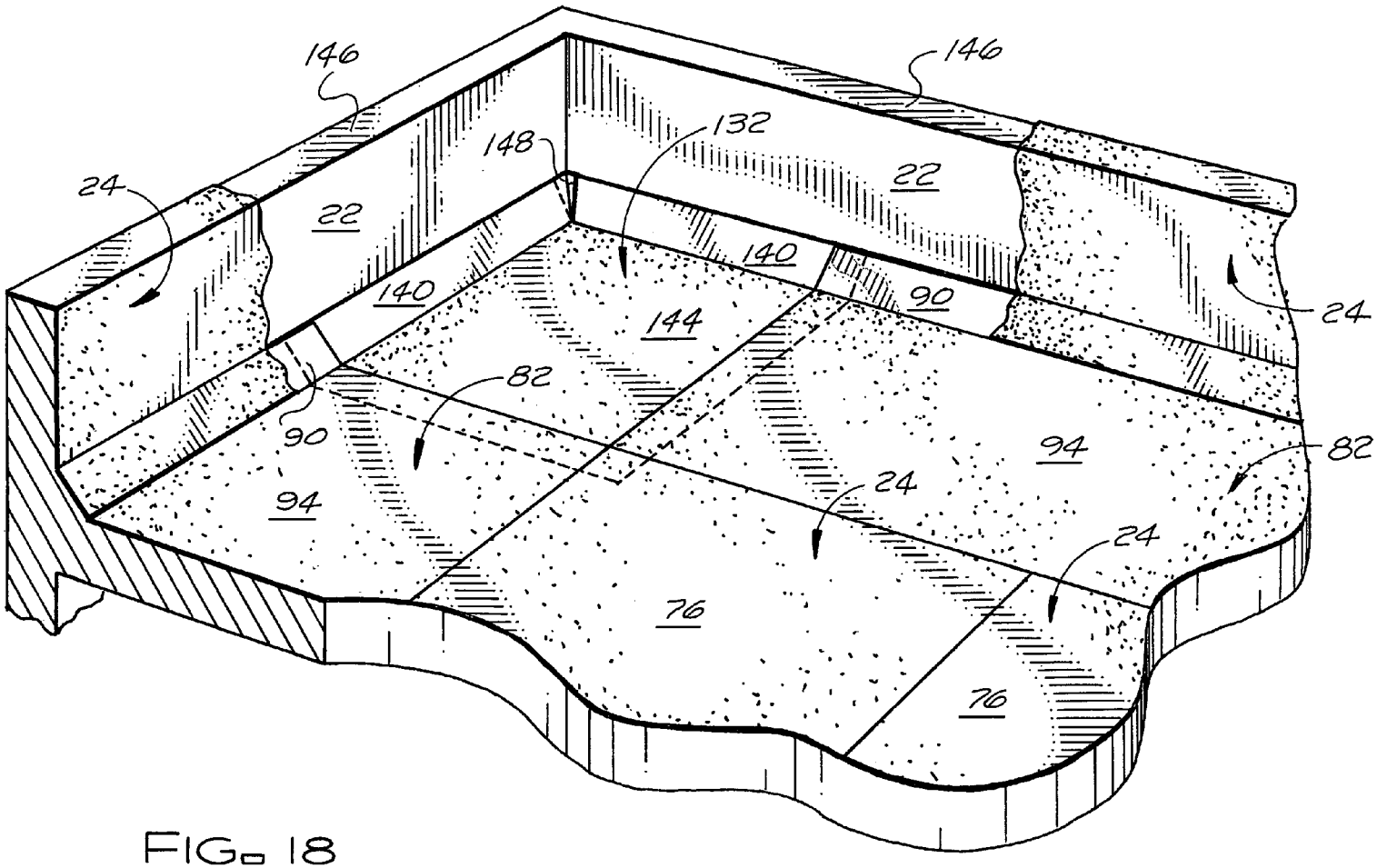
FIG. 18 is a partial schematic perspective view of the corner of a roof, with portions of the roofing system broken away, to show the corner end lap connector cap sheet of FIGS. 15 to 17 as applied in a typical roofing system.

As shown in FIGS. 15 to 18, the corner end lap connector cap sheet assembly 130 of the subject invention has: a waterproof fire-retardant self-adhering corner end lap connector cap sheet 132, a bottom surface release sheet 134 that forms a bottom surface of the end lap connector cap sheet assembly, and four top surface edge portion release sheets 136 that form the four edge portions of a top surface of the corner end lap connector cap sheet assembly. With the bottom release sheet 134 of the corner end lap connector cap sheet assembly removed, the self-adhering bottom major surface 138 of the waterproof fire-retardant self-adhering corner end lap connector cap sheet 132 can be adhered to an underlying roofing system layer, preferably formed by a plurality of the waterproof self-adhering base sheets 22, by pressing the waterproof self-adhering corner end lap connector cap sheet 132 against the top surface of the underlying roofing system layer. With their top surface edge portion release sheets 136 removed, two of the top self-adhering surfaces 140 of the edge portions of the waterproof self-adhering corner end lap connector cap sheet 132 are typically bonded to overlapping end edge portions of self-adhering flashing cap strips 82, as shown in FIG. 18, in the formation of a corner flashing of a roofing system. With their top surface edge portion release sheets 136 removed, the other two top self-adhering surfaces 140 of the edge portions of the waterproof self-adhering corner end lap connector cap sheet 132 are typically bonded to overlapping lateral edge portions of self-adhering cap sheets 24 that overlie the inner surface of the parapet wall 146 extending up from the peripheral edge of the roof deck. In FIG. 18, the self-adhering cap sheets 24 overlying the inner surface of the parapet wall 126 are broken away to better show the base sheets 22 on the wall underlying the cap sheets 24 and the two top self-adhering surfaces 140 of the edge portions of the waterproof self-adhering corner end lap connector cap sheet 132 that are overlaid by and bonded to the lateral edge portions of these self-adhering cap sheets 24. As shown at 148 in FIG. 18, where the edge portions 140 extend up the cant strip at the corner, the edge portions 140 are preferably slit and overlapped to prevent the edge portions from bulging outward. Since the surfaces of the overlapping portions of the edge portions 140 bonded together at 148 are both self-adhering surfaces, a very strong watertight bond can be formed along the overlap 148. The watertight bonds between the self-adhering top surfaces 140 of the edge portions of the corner end lap connector cap sheet 132 and the self-adhering flashing cap strips 82 and cap sheets 24 can be effected primarily by the application of pressure. Heat, a cold applied adhesive, sealing tape, etc. do not have to be used to effect the watertight bond between the self-adhering corner end lap connector cap sheet 132 and the self-adhering flashing cap strips 82 and cap sheets 24.

The waterproof self-adhering corner end lap connector cap sheet 132 of the corner end lap connector cap sheet assembly 130 may be of various lengths, widths, and thicknesses, but preferably, the self-adhering corner end lap connector cap sheet 132 is a square in shape with each side of the square having the same dimension as the width of the cap sheet 24. Currently cap sheets 24 are about 39⅜ inches in width (between 880 and 1020 millimeters in width) and, preferably, the waterproof self-adhering corner end lap connector cap sheet 132 is about 39⅜ inches long by about 39⅜ wide (880 to 1020 millimeters long by 880 to 1020 millimeters wide) and between 0.08 and 0.40 inches thick (between about 2 and about 5 millimeters thick). The waterproof fire-retardant self-adhering corner end lap connector cap sheet 132 has a reinforcing layer 142 encapsulated within modified bitumen. The modified bitumen forms a bottom layer and the self-adhering bottom major surface 138 of the waterproof fire-retardant self-adhering corner end lap connector cap sheet 132. The modified bitumen also forms an upper layer and the self-adhering top surfaces 140 of the edge portions of the top major surface of the waterproof fire-retardant self-adhering corner end lap connector cap sheet 132. The self-adhering top surfaces 120 of edge portions of the top major surface of the waterproof fire-retardant self-adhering corner end lap connector cap sheet 132 are each between about 3 inches and about 13 inches wide and preferably about 8 inches wide (between about 75 and about 320 millimeters wide and preferably about 200 millimeters wide) and the surfaces extend along the edges of the self-adhering corner end lap connector cap sheet 132 for the entire lengths of the edges of the corner end lap connector cap sheet. The remainder 144 of the top major surface of the waterproof fire-retardant self-adhering corner end lap connector cap sheet 132 is surfaced with a conventional surfacing material such as but not limited to roofing granules, sand, or other coating materials.

The self-adhering bottom major surface 138 and the self-adhering top surfaces 140 of the edge portions of the top major surface of the waterproof fire-retardant self-adhering corner end lap connector cap sheet 132 are free of surfacing materials such as talc, sand, polymeric films or other non-adhesive materials to facilitate: the bonding of the self-adhering bottom major surface 138 of the corner end lap connector cap sheet 132 to an underlying roofing system layer of base sheets (preferably, self-adhering base sheets 22) and the self-adhering top surfaces 140 of edge portions of the corner end lap connector cap sheet to overlapping end edge portions of self-adhering flashing cap strips 82 and the overlapping lateral edge portions of the self-adhering cap sheets 24 extending up the parapet wall 146.

The reinforcing layer 142 of the waterproof fire-retardant self-adhering corner end lap connector cap sheet 132 is typically a non-woven polyester, fiberglass, or polyester/fiberglass reinforcement mat. The self-adhering modified bitumen of the waterproof self-adhering corner end lap connector cap sheet 132 may be the same as that specified above for the self-adhering base sheets 22.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. For example, for certain roofing applications, one or more of the self-adhering roofing components of the subject invention may also be used in a roofing system with other roofing components that are not self-adhering to form the roofing system.

Thus, the invention is not intended to be limited to the specific embodiments disclosed, but is to be limited only by the claims appended hereto.

What is claimed is:

1. A method of installing a roofing system for a roof having an intersection of roof planes wherein the roof has a first surface extending in a first plane and a second surface extending in a second plane that intersects the plane of the first surface to form the roof surface intersection; and the roofing system has at least one layer of waterproof base sheets overlying the first and second roof surfaces, including the roof surface intersection, that are secured to the first and second roof surfaces; the method comprising:

providing a flashing cap strip assembly consisting essentially of a waterproof self-adhering flashing cap strip for forming part of a waterproof cap sheet roofing system layer and adhering to an underlying roofing system layer; a bottom surface release sheet forming a bottom surface of the flashing cap strip assembly; and top surface lateral edge portion release sheets forming lateral edge portions of a top surface of the flashing cap strip assembly;

the waterproof self-adhering flashing cap strip having a length, a width, a thickness, and a longitudinally extending centerline; the waterproof self-adhering flashing cap strip having a bottom major surface and a top major surface defined by the length and the width of the waterproof self-adhering flashing cap strip; the waterproof self-adhering flashing cap strip consisting essentially of a reinforcing layer encapsulated within a self-adhering bitumen, the bottom major surface of the self-adhering flashing cap strip that is formed by the self-adhering bitumen, and the top major surface of the self-adhering flashing cap strip that has self-adhering lateral edge portions formed by the self-adhering bitumen and a coated central portion that extends between the lateral edge portions of the top major surface;

the bottom surface release sheet overlying and being substantially coextensive with the bottom major surface of the waterproof self-adhering flashing cap strip to protect the bottom major surface of the waterproof self-adhering flashing cap strip from damage during storage, shipment and handling and being removable from the bottom major surface of the waterproof self-adhering flashing cap strip immediately prior to installation of the waterproof self-adhering flashing cap strip on an underlying layer of a roofing system; the bottom major surface of the waterproof self-adhering flashing cap strip, with the bottom surface release sheet removed, being self-adhering for forming a watertight bond with an underlying roofing system layer primarily by the application of pressure;

the top surface release sheets overlying and being substantially coextensive with the self-adhering lateral edge portions of the top major surface of the waterproof self-adhering flashing cap strip to protect the self-adhering lateral edge portions of the top major surface of the waterproof self-adhering flashing cap strip from damage during storage, shipment and handling and being removable from the self-adhering lateral edge portions of the top major surface of the waterproof self-adhering flashing cap strip immediately prior to an application of adjacent cap sheets to the self-adhering lateral edge portions of the top major surface of the waterproof self-adhering flashing cap strip in the formation of a cap sheet roofing layer; the self-adhering lateral edge portions of the top major surface the waterproof self-adhering flashing cap strip, with the top surface release sheets removed, being self-adhering for forming a watertight bond with adjacent cap sheets of a cap sheet layer primarily by the application of pressure;

removing the bottom surface release sheet from the waterproof self-adhering flashing cap strip to expose the self-adhering bitumen of the bottom surface of the waterproof self-adhering cap strip;

locating the waterproof self-adhering flashing cap strip over the roof surface intersection with the waterproof self-adhering flashing cap strip extending outward from both sides of the roof surface intersection and the longitudinal centerline of the waterproof self adhering flashing strip extending substantially parallel to the roof surface intersection;

applying pressure to the waterproof self-adhering flashing cap strip to thereby bond the waterproof self adhering flashing cap strip to the underlying base sheet layer at and adjacent the roof surface intersection with the self-adhering bitumen;

removing the top surface release sheets from the first and second self-adhering lateral edge portions of the top surface of the waterproof self-adhering flashing cap strip to expose the self-adhering bitumen of the first and second self-adhering lateral edge portions;

overlapping and bonding a lateral edge portion of a first of the waterproof cap sheets to the first self-adhering lateral edge portion of the waterproof self-adhering flashing cap strip by the application of pressure and overlapping and bonding a lateral edge portion of a second of the waterproof cap sheets to the second self-adhering lateral edge portion of the waterproof self-adhering flashing cap strip by the application of pressure.

2. The method of installing a roofing system for a roof having an intersection of roof planes according to claim 1, wherein:

the waterproof base sheet layer comprises waterproof self-adhering base sheets; each of the waterproof self-adhering base sheets having a length, a width and a thickness; each of the waterproof self-adhering base sheets having a bottom major surface and a top major surface defined by the length and the width of the waterproof self-adhering base sheet; each of the waterproof self-adhering base sheets consisting essentially of a reinforcing layer encapsulated within a self-adhering bitumen that forms the bottom major surface and the top major surface of the waterproof self-adhering base sheet; and the self-adhering bitumen of the bottom major surface of the waterproof flashing cap strip and the top major surfaces of the waterproof self-adhering base sheets overlaid by the waterproof flashing cap strip are the sole means for bonding the waterproof self-adhering flashing cap strip to the waterproof self-adhering base sheets overlaid by the waterproof self-adhering cap strip; and the pressure applied to the waterproof self-adhering flashing cap strip to thereby bond the waterproof self adhering flashing cap strip to the underlying base sheet layer at and adjacent the roof surface intersection forms the bond with the self-adhering bitumen of the bottom major surface of the waterproof self-adhering flashing cap strip and the top major surface of the waterproof self-adhering base sheets overlaid by the waterproof self-adhering flashing cap strip.

* * * * *